US009045298B2

(12) United States Patent
Shin et al.

(10) Patent No.: US 9,045,298 B2
(45) Date of Patent: Jun. 2, 2015

(54) PAPER FEEDING APPARATUS AND IMAGE FORMING APPARATUS ADOPTING THE SAME

(75) Inventors: Sang-kyu Shin, Suwon-si (KR); Ho-young Choi, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 18 days.

(21) Appl. No.: 13/613,378

(22) Filed: Sep. 13, 2012

(65) Prior Publication Data

US 2013/0168920 A1 Jul. 4, 2013

(30) Foreign Application Priority Data

Jan. 3, 2012 (KR) ..... 10-2012-0000649

(51) Int. Cl.

| | |
|---|---|
| ***B65H 1/24*** | (2006.01) |
| ***B65H 3/06*** | (2006.01) |
| ***B65H 3/52*** | (2006.01) |
| *B65H 1/12* | (2006.01) |

(52) U.S. Cl.

CPC ..... *B65H 3/0607* (2013.01); *B65H 3/0661* (2013.01); *B65H 1/24* (2013.01); *B65H 1/12* (2013.01); *B65H 2404/144* (2013.01); *B65H 3/0669* (2013.01); *B65H 3/5261* (2013.01); *B65H 2403/512* (2013.01)

(58) Field of Classification Search

USPC ..... 271/121–127, 160, 167

See application file for complete search history.

(56) References Cited

U.S. PATENT DOCUMENTS

| | | | | |
|---|---|---|---|---|
| 5,725,208 | A * | 3/1998 | Miyauchi | 271/10.09 |
| 5,895,038 | A * | 4/1999 | Takashima | 271/114 |
| 5,909,872 | A * | 6/1999 | Takahashi | 271/116 |
| 5,997,198 | A * | 12/1999 | Murayama et al. | 400/624 |
| 6,000,689 | A * | 12/1999 | Furuki et al. | 271/10.11 |
| 6,378,858 | B1 * | 4/2002 | Suga | 271/10.01 |
| 6,581,925 | B1 * | 6/2003 | Shea et al. | 271/125 |
| 7,165,765 | B2 * | 1/2007 | Sonoda et al. | 271/122 |
| 7,484,724 | B2 * | 2/2009 | Yamanaka et al. | 271/121 |
| 7,503,559 | B2 * | 3/2009 | Yoshida | 271/186 |
| 7,624,979 | B2 * | 12/2009 | Masutani | 271/167 |
| 2007/0007711 | A1 * | 1/2007 | Suzuki et al. | 271/121 |
| 2009/0140485 | A1 * | 6/2009 | Okuda et al. | 271/3.14 |
| 2012/0126475 | A1 * | 5/2012 | Shin et al. | 271/117 |

* cited by examiner

*Primary Examiner* — Ernesto Suarez

(74) *Attorney, Agent, or Firm* — Staas & Halsey LLP

(57) ABSTRACT

A paper feeding apparatus includes a pickup roller, a knock-up plate to accommodate recording media thereon and capable of moving to a pickup position and a release position, a forward roller to transfer a recording medium picked up by the pickup roller, a retard roller capable of moving to a contact position and to a separation position, a first control unit to move the knock-up plate to the pickup position and the release position, and a second control unit to move the knock-up plate to the contact position and the separation position, wherein the first control unit and the second control unit are driven by a single driving motor.

22 Claims, 12 Drawing Sheets

PAPER FEEDING APPARATUS AND IMAGE FORMING APPARATUS ADOPTING THE SAME

CROSS-REFERENCE TO RELATED APPLICATIONS

This application claims priority under 35 U.S.C. §119 from Korean Patent Application No. 10-2012-0000649, filed Jan. 3, 2012, in the Korean Intellectual Property Office, the disclosure of which is incorporated herein in its entirety by reference.

BACKGROUND OF THE INVENTION

1. Field of the Invention

The present general inventive concept relates to a paper feeding apparatus having an improved paper-feeding reliability and an image forming apparatus using the same.

2. Description of the Related Art

Image forming apparatuses form an image on a recording medium. Examples thereof include printers, copy machines, facsimile machines, and all-in-one devices implemented by combining functions of a printer, a copy machine, and a facsimile machine.

Such image forming apparatuses include a paper feeding apparatus for picking up recording media from a cassette sheet by sheet and feeding the recording medium to a printing device.

In the paper feeding apparatus, a knock-up plate for stacking recording media needs to be repeatedly raised and lowered in order to prevent a paper jam between a pickup roller and the knock-up plate that may cause a withdrawal of the cassette and to provide recording media stacked in a plurality of paper feeding units to the pickup roller in an insertion of the cassette.

In addition, a plurality of sheets of paper may be picked up due to static electricity occurring between recording media or a frictional force change between a recording medium and the pickup roller according to a change in a surrounding environment such as temperature and humidity, and accordingly, to prevent the plurality of sheets of paper from being transferred to a printing device, a retard roller is installed to continuously provide a frictional force against a paper transfer direction. It is necessary to release the frictional force provided by the retard roller to a recording medium needs for a correct transfer when the recording medium is transferred to a transfer roller after passing through the pickup roller.

It is also necessary to individually prepare a first driving motor for controlling raising/lowering of the knock-up plate and a second driving motor for controlling raising/lowering of the retard roller. In this case, additional driving axes connected to the first driving motor and the second driving motor, link members, and a control member are used, thereby causing a space limitation and a cost increase in image forming apparatuses that are gradually being miniaturized and light in weight.

SUMMARY OF THE INVENTION

The present general inventive concept provides a paper feeding apparatus capable of perform paper-feeding securely and reliably and minimizing a space and components required thereto and an image forming apparatus adopting the same.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a paper feeding apparatus including a pickup roller, a knock-up plate to receive recording media thereon and capable of moving to a pickup position at which a recording medium contacts with the pickup roller and a release position at which the recording medium and the pickup roller are separated from each other, a forward roller to transfer a recording medium picked up by the pickup roller, a retard roller capable of moving to a contact position at which the retard roller contacts with the forward roller to prevent a multiple-paper transfer by applying a frictional force to a rear side of a recording medium being transferred between the retard roller and the forward roller and to a separation position at which the retard roller is separated from the forward roller, a first control unit to move the knock-up plate to the pickup position and the release position, and a second control unit to move the knock-up plate to the contact position and the separation position, wherein the first control unit and the second control unit are driven by a single driving motor.

The paper feeding apparatus may further include a first pressure member to apply a first elastic force to the knock-up plate in a direction towards the pickup position. The first control unit may include a first cam having a first cam trajectory to allow the knock-up plate to move to the pickup position by the first elastic force or to the release position by moving the knock-up plate in a direction opposite to the first elastic force according to a rotational phase of the first cam.

The paper feeding apparatus may further include a second pressure member to apply a second elastic force to the retard roller in a direction towards the contact position. The second control unit may include a second cam having a second cam trajectory to allow the retard roller to move to the contact position by the second elastic force or to the separation position by moving the retard roller in a direction opposite to the second elastic force according to a rotational phase of the second cam.

The first cam and the second cam may be assembled with a driving axis rotated by the driving motor.

The paper feeding apparatus may further include a knock-up lever disposed between the first cam and the knock-up plate, wherein the knock-up lever contacts the first cam trajectory to move the knock-up plate.

The paper feeding apparatus may further include a kicker moving to a first position at which a recording medium is allowed to pass between the forward roller and the retard roller and to a second position at which the kicker pushes a recording medium separated by the retard roller in a direction opposite to a recording medium transfer direction by the forward roller.

The paper feeding apparatus may further include a frame, a holder member to support the retard roller to be rotatable and to be supported by the frame so that the retard roller can rotatably move to the contact position and the separation position, and a lever member rotatably supported by the frame and connected to the holder member. The kicker may be assembled with the frame to rotatably move to the first position and the second position and connected to the lever member such that the second cam trajectory contacts with the kicker to move the retard roller passing through the lever member and the holder member.

The paper feeding apparatus may further include a third pressure member to apply an elastic force to the kicker in a direction towards the first position.

The third pressure member may be interposed between the kicker and the lever member.

A clutch may be interposed between the driving motor and the first and second control units to selectively block a driving force to the first and second control units.

The foregoing and/or other features and utilities of the present general inventive concept may also be achieved by providing a paper feeding apparatus including a pickup member to pick up and transfer a recording medium, a knock-up plate to receive recording media and to make a contact between a recording medium and the pickup member, and a retard roller to apply a frictional force to a rear side of a recording medium being transferred between the retard roller and the pickup member, the paper feeding apparatus including a first cam to raise or lower the knock-up plate toward or from the pickup member; a second cam to make a contact or separation between the retard roller and the pickup member, a driving axle with which the first cam and the second cam are assembled, and a driving motor to rotate the driving axle.

The paper feeding apparatus may further include a first pressure member to apply an elastic force to the knock-up plate in a direction towards the pickup member, and a second pressure member to apply an elastic force to the retard roller in the direction towards the pickup member.

The paper feeding apparatus may further include a kicker to move to a first position at which a recording medium is allowed to pass between the pickup member and the retard roller and to a second position at which the kicker pushes a recording medium separated by the retard roller in a direction opposite to a recording medium transfer direction by the pickup member, wherein the second cam moves the kicker to the first position and the second position.

The paper feeding apparatus may further include a third pressure member to apply an elastic force to the kicker in a direction towards the first position.

The second cam may contact or separate the retard roller with or from the pickup member through the kicker.

The foregoing and/or other features and utilities of the present general inventive concept may also be achieved by providing an image forming apparatus including a printing device to print a recording medium, the paper feeding apparatus to feed the recording medium to the printing device, and a discharge device to discharge the recording medium printed by the printing device.

The foregoing and/or other features and utilities of the present general inventive concept may also be achieved by providing a paper feeding apparatus usable with an image forming apparatus, including a knock-up plate to accommodate recording media thereon, a pickup roller to pick up the recording medium from the knock-up plate, a forward roller disposed to receive the picked up recording medium, a retard roller disposed to transfer the picked up recording medium with the forward roller in a transferring direction; a first control unit to control the knock-up plate to move with respect to the pickup roller, a second control unit to control the retard roller to move with respect to the forward roller, and a single driving axle connected to the first control unit and the second control unit.

The paper feeding apparatus may further include a kicker connectable to the single driving axle to remove a second recording medium from a space between the forward roller and the retard roller. The recording medium and the second recording medium may be picked up and fed between the forward roller and the retard roller, the recording medium may be transferred according to a friction of the forward roller, and the second recording medium may remain in the space according to a friction of the retard roller.

The first control unit may include first cam to move the knock-up plate to a pickup position and a release position, and the second control unit may include a second cam to move the retard roller to a contact position and a separation position.

The paper feeding apparatus may further include a single driving motor to generate a first driving force to the pickup roller and a second driving force to the signal driving axle.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
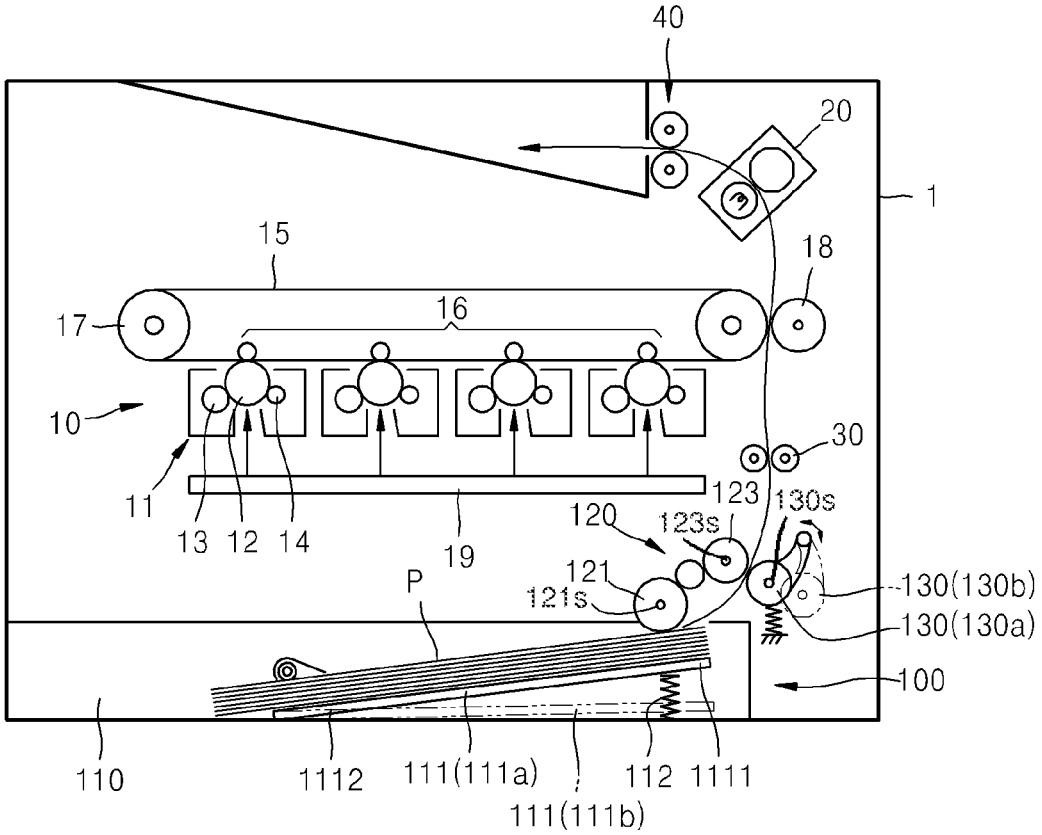
FIG. 1 is a schematic configuration illustrating an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a schematic configuration illustrating an image forming apparatus according to an embodiment of the present general inventive concept.

As illustrated in FIG. 1, the image forming apparatus may include a paper feeding apparatus 100, a printing device 10, and a discharge device 40.

The paper feeding apparatus 100 accommodates recording media P and feeds the recording media P to the printing device 10. The discharge device 40 discharges the recording media P, which have passed through the printing device 10, to an outside thereof.

The printing device 10 forms an image on a recording medium P fed by the paper feeding apparatus 100. The printing device 10 may form an image on the recording medium P by electrophotography. The printing device 10 may include developers 11, an intermediate transfer belt 15, intermediate transfer rollers 16, a final transfer roller 18, a light-exposure unit 19, and a fuser 20. The printing device 10 forms a color image by using cyan, magenta, yellow, and black color toners. The printing device may have four developers 11 to contain the cyan, magenta, yellow, and black color toners, respectively.

The light-exposure unit 19 forms a static latent image by radiating light modulated according to image information onto a photosensitive drum 12 of a corresponding one of the developers 11. The light-exposure unit 19 may employ a light emitting diode (LED) light-exposure unit in which a plurality of LEDs arranged in a main scanning direction selectively emit light. Alternatively, the light-exposure unit 19 may employ a laser scanning unit (LSU) to deflect light radiated from a laser diode in the main scanning direction by using a light deflector and radiating the deflected light onto the photosensitive drum 12. The main scanning direction may be a direction perpendicular to a feeding direction of the recording medium P with respect to the printing device 10.

The photosensitive drum 12 is an example of a photosensitive body on which a static latent image is formed. The photosensitive drum 12 may have a cylindrical metal pipe and a photosensitive layer formed around the cylindrical metal pipe and having light conductivity.

The developer 11 forms a toner image by attaching a toner contained therein to the corresponding static latent image formed on the photosensitive drum 12. The developer 11 may include a developing roller 13 to supply the toner contained in the developer 11 to the static latent image formed on the photosensitive drum 12 and an electrifying roller 14 to electrify a surface of the photosensitive drum 12 with a uniform potential.

A developing bias voltage usable to supply a toner to a static latent image is applied to the developing roller 13, and an electrifying bias voltage is applied to the electrifying roller 14. Here, a corona electrifying unit (not illustrated) may be employed instead of the electrifying roller 14.

The intermediate transfer belt 15 is an intermediate transfer medium to which the toner image is temporarily transferred before the toner image is finally transferred to the recording medium P, and that is supported by supporting rollers 17 to be able to circulate.

Each of the intermediate transfer rollers 16 is an example of an intermediate transfer member to transfer the toner image formed on the photosensitive drum 12 to the intermediate transfer belt 15. Four intermediate transfer rollers 16 are disposed to face four photosensitive drums 12, respectively, with the intermediate transfer belt 15 therebetween. An intermediate transfer bias voltage usable to transfer the toner image formed on the photosensitive drum 12 to the intermediate transfer belt 15 is applied to the intermediate transfer roller 16. The cyan, magenta, yellow, and black color toner images formed on the four photosensitive drums 12 in the four developers 11, respectively, are transferred to the intermediate transfer belt 15 by an intermediate transfer electric field formed by the intermediate transfer bias voltage such that a color image can be formed from the four toner images.

The final transfer roller 18 is an example of a final transfer unit to transfer the color image formed on the intermediate transfer belt 15 to the recording medium P. A final transfer bias voltage usable to transfer the color image formed on the intermediate transfer belt 15 to the recording medium P may be applied to the final transfer roller 18. A corona transfer unit (not illustrated) may be employed instead of the final transfer roller 18. While the recording medium P is travelling between the intermediate transfer belt 15 and the final transfer roller 18, the toner image on the intermediate transfer belt 15 is transferred to the recording medium P by a final transfer electric field formed by the final transfer bias voltage.

The fuser 20 fixes the color image to the recording medium P by providing heat and pressure to the color image transferred to the recording medium P.

The paper feeding apparatus 100 accommodates the recording media P and may include a paper feeding cassette 110, a pickup roller 121 disposed on a first shaft 121*s*, a forward roller 123 disposed on a second shaft 123*s*, a knock-up plate 111, and a retard roller 130 disposed on a third shaft 130*s*, as illustrated in FIG. 1, to feed the recording media P to the printing device 10. The pickup roller 121 and the forward roller 123 may form a pickup unit 120. The paper feeding apparatus 100 may feed the recording medium P toward a feeding roller 30 to feed the recording medium P toward the printing device 10. The feeding roller 30 may be included in the printing unit 10.

The pickup roller 121 picks up a recording medium P by contacting with the recording medium P. The pickup roller 121 may be connected to a driving motor (M of FIG. 2A) to rotate by a driving force received from the driving motor M to pick up the recording medium P.

A clutch (C1 of FIG. 2A) may be interposed between the pickup roller 121 and the driving motor M. A driving force delivered from the driving motor M to the pickup roller 121 may be selectively blocked by the clutch C1. Although not illustrated, the clutch C1 may use, for example, a solenoid and a spring or use an electromagnet.

The pickup roller 121 may have, for example, a cylindrical shape. With the cylindrical shape, a pickup speed of the pickup roller 121 may increase. The pickup roller 121 having a cylindrical shape may adjust a pickup period of the recording media P by using the clutch C1.

The forward roller 123 transfers the recording medium P picked up by the pickup roller 121 toward the printing device 10 through the feeding roller 30, for example. To transfer the picked-up recording medium P, the forward roller 123 is disposed adjacent to the pickup roller 121 to receive the picked up recording medium P.

The knock-up plate 111 is a member to control the recording medium P to contact the pickup roller 121. The knock-up plate 111 is assembled with a paper feeding cassette 110 and the recording media P are stacked thereon. The paper feeding cassette 110 is detachably inserted into a main body 1 of the image forming apparatus. The knock-up plate 111 is elastically biased in a direction of the pickup roller 121 so that the stacked recording medium P contacts the pickup roller 121. The knock-up plate 111 may be connected to a first pressure member 112 to be elastically biased in the direction of the pickup roller 121. One end of the first pressure member 112 is connected to the knock-up plate 111, and the other end thereof is connected to the paper feeding cassette 110.

For example, the knock-up plate 111 may be rotatably assembled with the paper feeding cassette 110. A front end 1111 of the knock-up plate 111 may be raised upwards or lower downwards by assembling the knock-up plate 111 with the paper feeding cassette 110 through a hinge axis at a rear end 1112 of the knock-up plate 111. The first pressure member 112 may be, for example, a compression coil spring, but the scope of the present general inventive concept is not limited thereto. The first pressure member 112 may employ various members capable of pressing the knock-up plate 111 towards the pickup roller 121.

The retard roller 130 provides a frictional force to a rear side of the recording medium P being transferred between the retard roller 130 and the forward roller 123 to prevent a multiple-paper transfer. The recording medium P may have a front side opposite to the rear side to face the pickup roller 121 or the forward roller 123.

The retard roller 130 is elastically biased in a direction of the forward roller 123 so that the recording medium P being transferred between the retard roller 130 and the forward roller 123 contacts the forward roller 123. The retard roller 130 is connected to a second pressure member 131 to be elastically biased in the direction of the forward roller 123.

The second pressure member 131 may be a compression coil spring, but the scope of the present general inventive concept is not limited thereto. The second pressure member 131 may employ various members capable of pressing the retard roller 130 towards the forward roller 123.

The retard roller 130 may be assembled with, for example, a frame (140 of FIG. 3B) assembled fixedly or detachably with or from the main body 1. The retard roller 130 may be assembled with the frame 140 through a holder member (133 of FIG. 3B). The holder member 133 supports the retard roller 130 to be rotatable and is hinge-assembled with the frame 140 so that the holder member 133 is rotatable. In this case, one end of the second pressure member 131 is connected to the holder member 133, and the other end thereof is connected to the frame 140. Then, the retard roller 130 is elastically biased in the direction of the forward roller 123 by the second pressure member 131.

The retard roller 130 has a torque greater than a frictional force between the recording media P and less than a frictional force by the forward roller 123 such that the retard roller 130 can rotate when the number of recording media P being transferred between the retard roller 130 and the forward roller 123 is 1, but the retard roller 130 resists rotation or does not rotate when the number of recording media P being transferred between the retard roller 130 and the forward roller 123 is 2 or more. Accordingly, the retard roller 130 may include a torque limiter (not illustrated). For example, a torque limiter using an electromagnet may be used. However, the present general inventive concept is not limited thereto, and various torque limiters, such as a torque limiter using an elastic spring, may be used.

It is possible in every predetermined period that the knock-up plate 111 is separated from the pickup roller 121 and the retard roller 130 is separated from the forward roller 123 such that the paper feeding apparatus 100 can provide a proper pickup and transfer operation and a paper jam prevention of the recording media P during a pickup operation and a feeding/transferring operation.

That is, as illustrated in FIG. 1, it is possible that the knock-up plate 111 periodically moves between a pickup position 111*a* at which a recording medium P contacts the pickup roller 121 and a release position 111*b* at which the recording medium P is separated from the pickup roller 121, and it is possible that the retard roller 130 periodically moves between a contact position 130*a* at which the retard roller 130 applies a frictional force to a rear side of the recording medium P and a separation position 130*b* at which the retard roller 130 is separated from the forward roller 123.

Figure 2A:
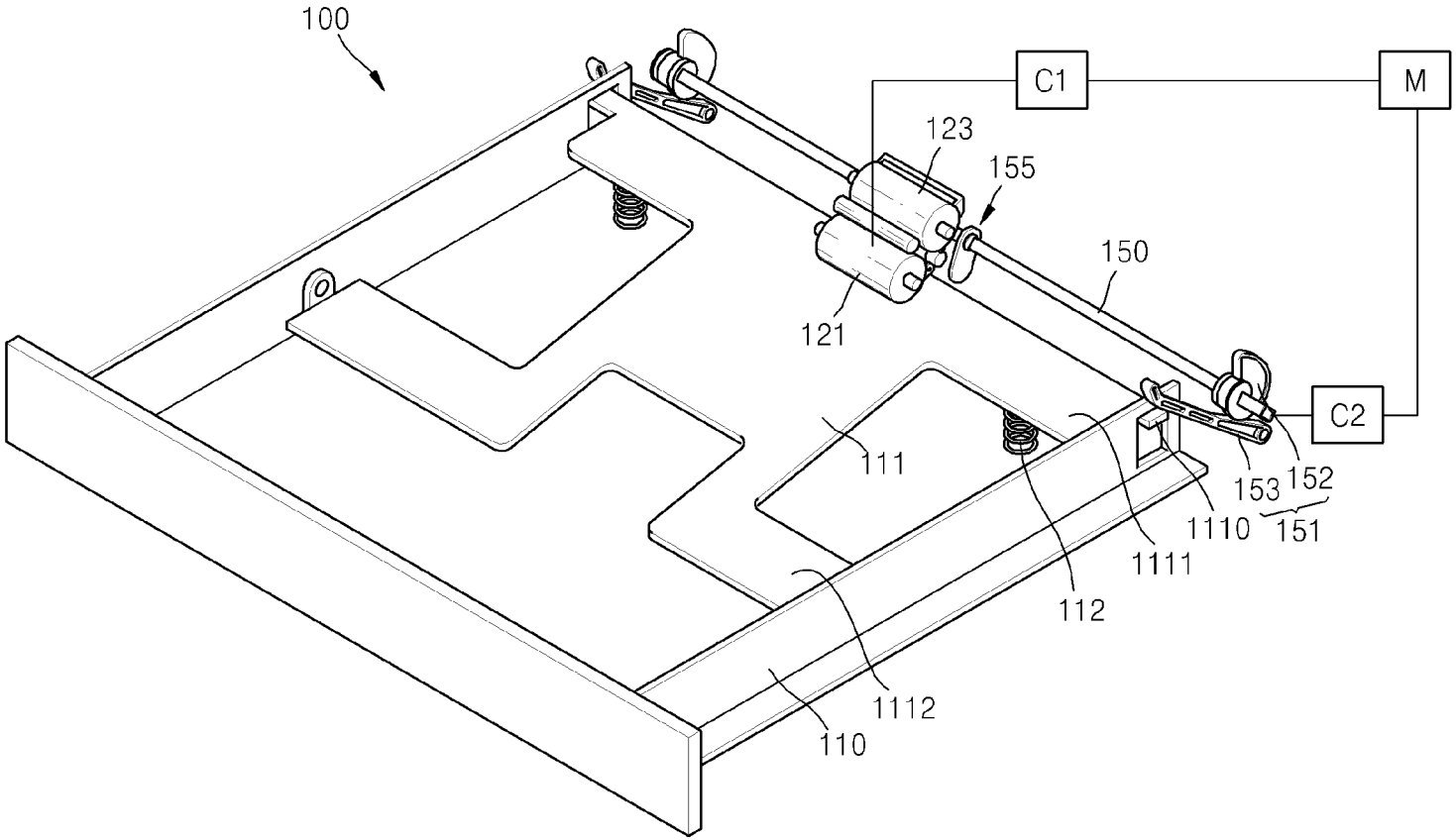
FIG. 2A is a schematic perspective view illustrating a paper feeding apparatus of the image forming apparatus according to an embodiment of the present general inventive concept.
Figure 2B:
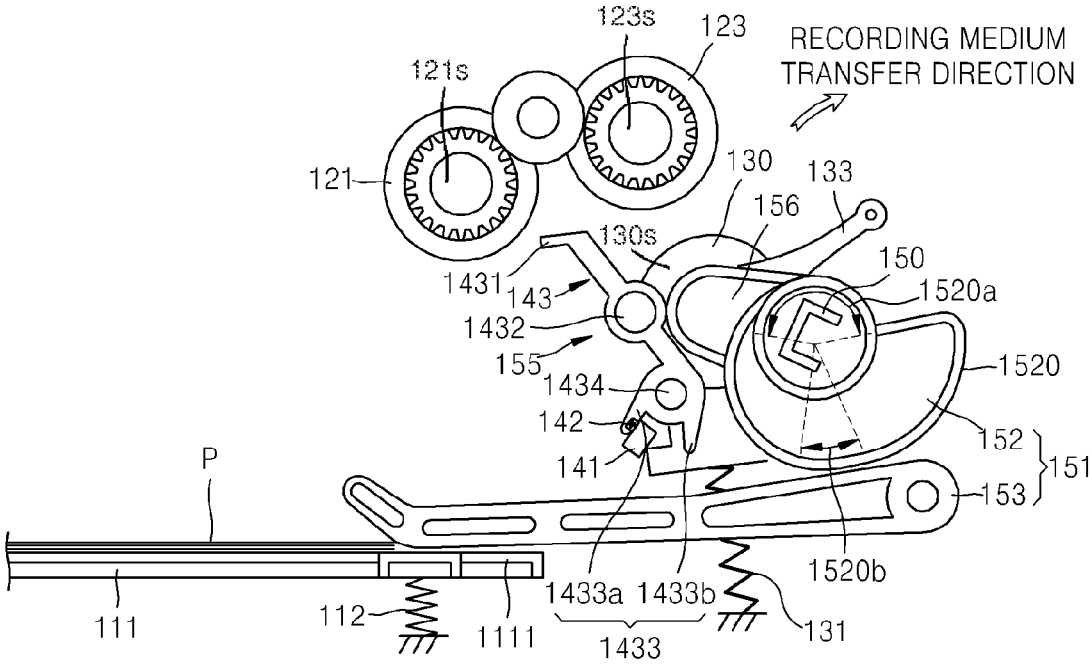
FIG. 2B is a right-side view illustrating a portion of the paper feeding apparatus of the image forming apparatus according to an embodiment of the present general inventive concept.
Figure 3A:
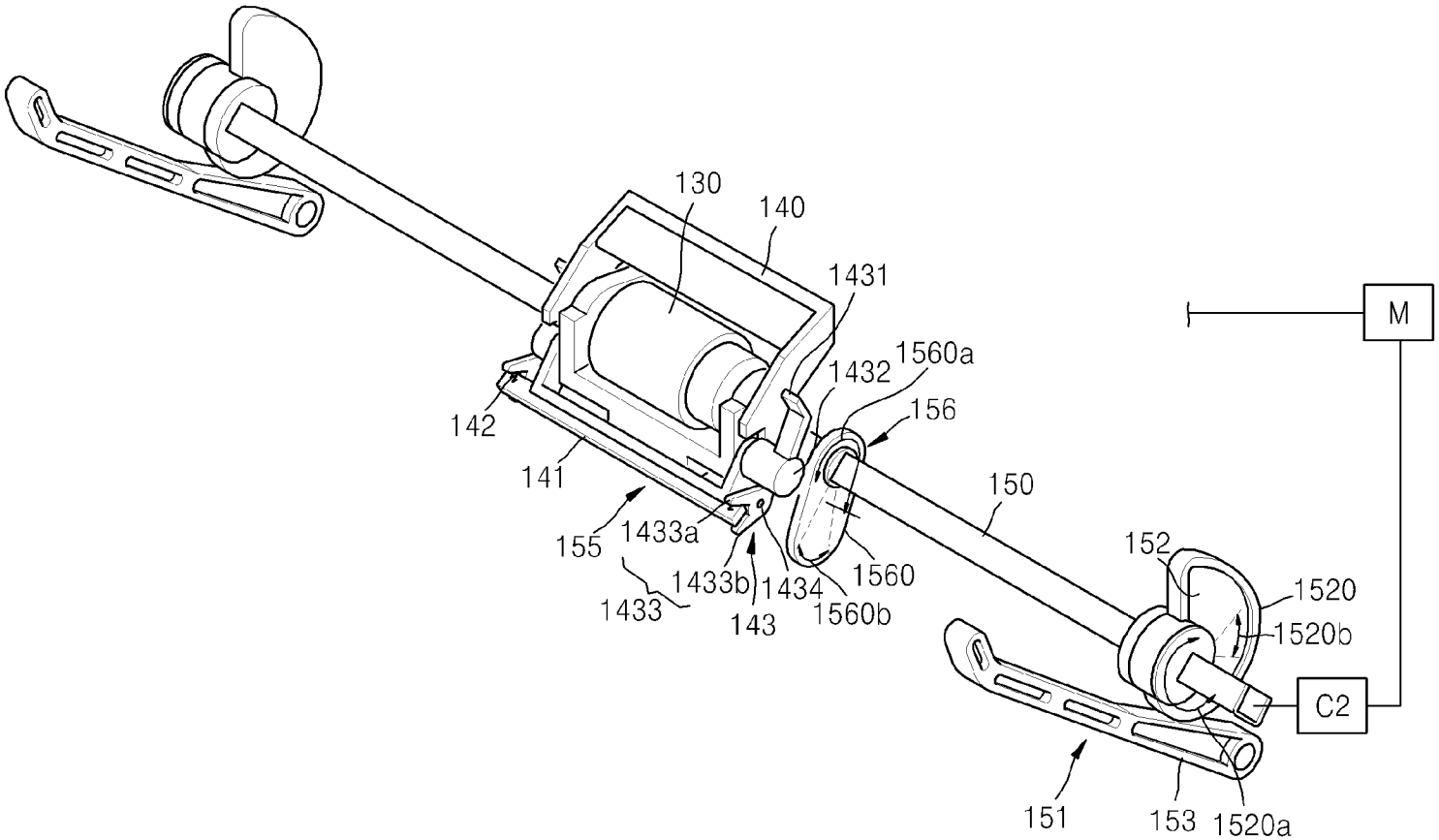
FIG. 3A is a partial perspective view illustrating a first control unit and a second control unit in the image forming apparatus according to an embodiment of the present general inventive concept.
Figure 3B:
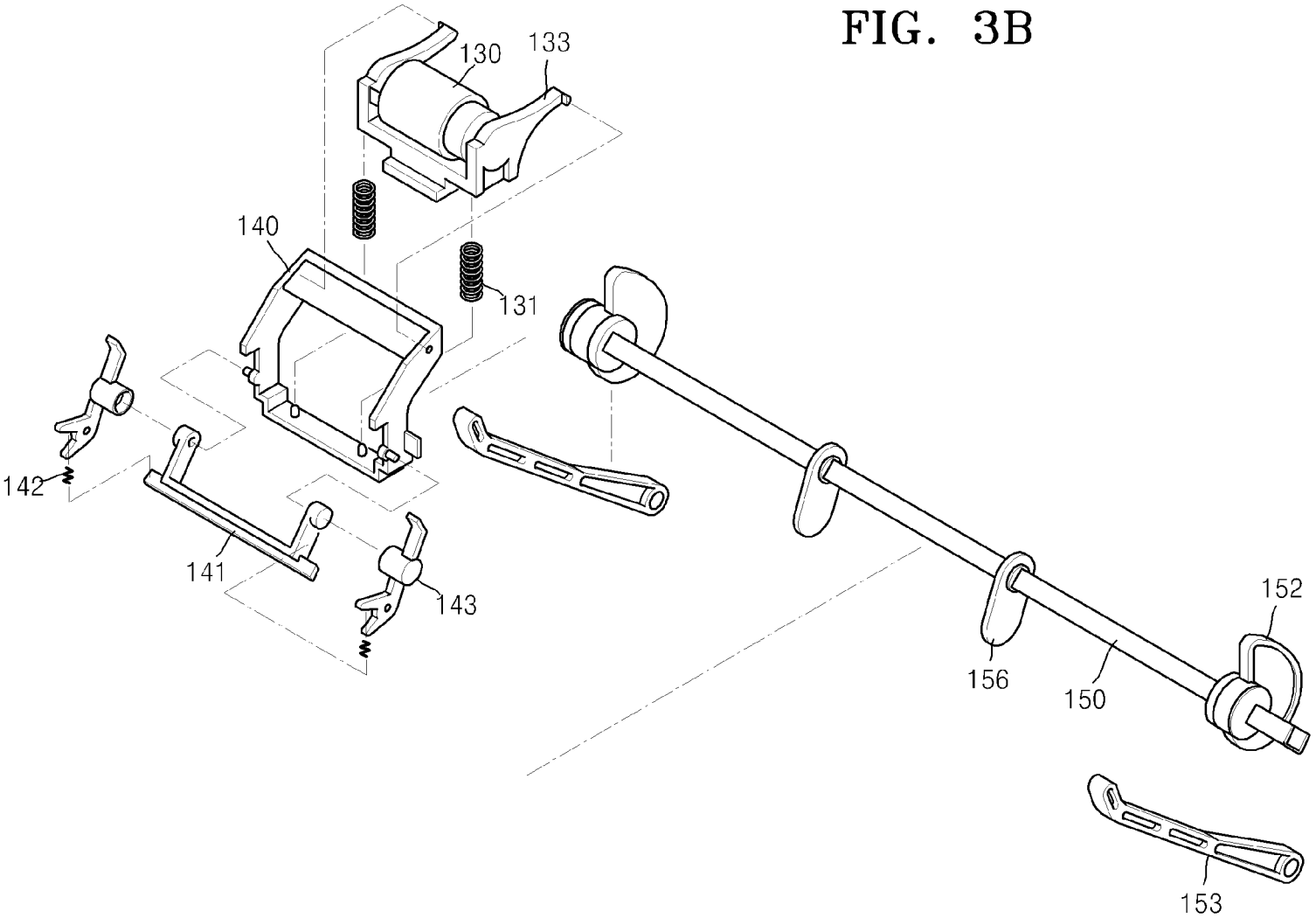
FIG. 3B is a separated perspective view of FIG. 3A.

FIG. 2A is a schematic perspective view illustrating the paper feeding apparatus 100 of the image forming apparatus according to an embodiment of the present general inventive concept, and FIG. 2B is a right-side view illustrating a portion of the paper feeding apparatus 100 of the image forming apparatus according to an embodiment of the present general inventive concept. FIG. 3A is a partial perspective view illustrating a first control unit 151 and a second control unit 155 in the image forming apparatus according to an embodiment of the present general inventive concept, and FIG. 3B is a separated perspective view of FIG. 3A.

The paper feeding apparatus 100 may include the first control unit 151 to control or move the knock-up plate 111 to the pickup position 111*a* and the release position 111*b*, the second control unit 155 to control or move the retard roller 130 to the contact position 130*a* and the separation position 130*b*, and the driving motor M that is electrically and/or mechanically connected to the first control unit 151 and the second control unit 155.

The driving motor M delivers a driving force to the first control unit 151 and the second control unit 155 through, for example, a single driving axle (or shaft) 150 as illustrated in FIG. 2A. A clutch C2 may be interposed between the driving motor M and the first and second control units 151 and 155. The clutch C2 may be used to selectively block the driving force delivered from the driving motor M to the first control unit 151 and the second control unit 155. Although not illustrated, the clutch C2 may use, for example, a solenoid and a spring or use an electromagnet.

The first control unit 151 controls the knock-up plate 111 to be raised or lowered with respect to the pickup roller 121.

The first control unit 151, for example, may include a first cam 152 and a knock-up lever 153.

The knock-up lever 153 is assembled to directly contact the knock-up plate 111. It is possible that the knock-up lever 153 may contact the knock-up plate 111 through an intermediate element disposed therebetween to deliver a force for a raising and lowering operation of the knock-up plate 111. The knock-up lever 153 contacts a contact part 1110 of the knock-up plate 111, as illustrated in FIG. 2A. The contact part 1110 is formed to protrude from both sides of a front end 1111 of the knock-up plate 111. The knock-up lever 153 contacts an upper side of the contact part 1110, and when the knock-up lever 153 lowers, the knock-up plate 111 is also lowered by being pushed by the knock-up lever 153, so that the knock-up plate 111 is moved or disposed at the release position 111*b* (refer to FIG. 4A).

Referring to FIG. 3A, the first cam 152 includes a first cam trajectory 1520, and the knock-up lever 153 contacts the first cam 152. The first cam 152 is assembled with the driving axle 150 to rotate according to a rotation of the driving axle 150.

The first cam 152 may allow the knock-up plate 111 to move to the pickup position 111*a* (refer to FIG. 4B) or the release position 111*b* (refer to FIG. 4A) according to a rotational phase of the first cam 152. The first cam trajectory 1520 may include a pickup section 1520*a* (refer to FIG. 4B) in which the knock-up plate 111 is allowed to move to the pickup position 111*a* and a release section 1520*b* (refer to FIG. 4A) in which the knock-up plate 111 is allowed to move to the release position 111*b*. The pickup position 111*a* is a position at which a recording medium P stacked on the knock-up plate 111 contacts the pickup roller 121, and the release position 111*b* is a position at which the recording medium P is separated from the pickup roller 121.

For example, as illustrated in FIG. 2A, the knock-up lever 153 has one end to be rotatably connected to a portion of the main body 1 and the other end to be movable with respect to the one end thereof. The one end of the knock-up lever 153 may have a rotational axis different from that of the first cam 152. A portion of the knock-up lever 153 contacts the contact part 1110 of the knock-up plate 111, and another portion of the knock-up lever 153 contacts the first cam 152. In this case, as illustrated in FIG. 2B, a distance from the driving axle 150 to a surface of the first cam 152 may be shorter at the pickup section 1520*a* than at the release section 1520*b*.

Thus, when the release section 1520*b* of the first cam 152 is located to face the knock-up lever 153, the knock-up lever 153 lowers away from the driving axle 150, and accordingly, the knock-up plate 111 contacting the knock-up lever 153 is also lowered with respect to the pickup roller 121, such that the knock-up plate 111 moves to or arrives at the release position 111*b*. When the pickup section 1520*a* of the first cam 152 is located to face the knock-up lever 153, the knock-up lever 153 contacting or facing the first cam 152 is raised towards the driving axle 150, and accordingly, since a force applied to the knock-up lever 153 by the first cam 152 is released, the knock-up lever 153 contacting the knock-up plate 111 is raised along with the knock-up plate 111 such that the knock-up plate 111 moves to or arrive at the pickup position 111*a*.

The second control unit 155 controls raising and lowering of the retard roller 130. The second control unit 155 may control feeding of the recording medium P such that the recording medium P is not further fed toward the feeding roller 30 (FIG. 1) but stopped at the retard roller 130 or the forward roller 123 (FIG. 1). In addition, the second control unit 155 may discharge a recording medium P for which transferring has been stopped by the retard roller 130. The discharged recording medium P may be returned from the stopped position to a stacking portion over the knock-up plate 111 by the second control unit 155.

The second control unit 155, for example, may include a lever member 141, a kicker 143, and a second cam 156, as illustrated in FIGS. 2B, 3A and 3B.

The retard roller 130 is rotatably assembled through the holder member 133 with the frame 140 fixedly assembled with the main body 1.

The lever member 141 interferes with the retard roller 130 such that the retard roller 130 can be raised or lowered with respect to the frame 140. The lever member 141 may have a hinge to be rotatably hinge-assembled with the frame 140. At least a portion of the lever member 141 may contact the holder member 133 to support the retard roller 130.

As described above, the lever member 141 controls or contacts the holder member 133 in a state where the lever member 141 is rotatably hinge-assembled with the frame 140. When the holder member 133 is raised by the second pressure member 131 connected to a lower part of the holder member 133, the lever member 141 contacting the holder member 133 is also raised.

The kicker 143 interferes with a rotation of the lever member 141 and discharges a recording medium P for which transferring has been stopped by the retard roller 130 in a direction opposite to a recording medium transfer direction.

For example, the kicker 143 may be rotatably assembled with the frame 140. The kicker 143 contacts the lever member 141. Accordingly, a rotation of the kicker 143 interferes with a rotation of the lever member 141, and vice versa. The kicker 143 includes a lever member contact part 1433 contacting with the lever member 141, as illustrated in FIG. 2B.

The kicker 143 may be, for example, rotatably assembled with the same axis as that of the lever member 141. The lever member contact part 1433 may have a shape having protrusions (tongs) and a recess portion formed between the protrusions (tongs) and may contact the lever member 141 disposed in the recess portion between the protrusions (tongs). The lever member contact part 1433 may include an upper contact part (or protrusion) 1433*a* contacting an upper part of the lever member 141 and a lower contact part (or protrusion) 1433*b* contacting a lower part of the lever member 141. The lever member contact part 1433 may interfere with the rotation of the lever member 141 by using the upper contact part 1433*a* and may prevent a breakaway (separation) of the kicker 143 from the frame 140 by using the lower contact part 1433*b*.

A third pressure member 142 may be interposed between the upper contact part 1433*a* of the lever member contact part 1433 and the lever member 141 such that the upper contact part 1433*a* can be separated from the lever member 141 when an external force is not applied between the upper contact part 1433*a* and the lever member 141.

The kicker 143 includes a recording medium contact part 1431 contacting with the recording medium P for which transferring has been stopped by the retard roller 130. The recording medium contact part 1431 may discharge the recording medium P by rotating in the direction opposite to the recording medium transfer direction at a position at which the recording medium contact part 1431 contacts a front end (leading edge) of the recording medium P. The recording medium contact part 1431 may have a shape having an end extended and bent from a main portion of the kicker 143 such that the recording medium contact part 1431 may stably discharge the recording medium P. The bent end of the recording medium contact part 1431 may push down the front end (leading edge) of the recording medium P which may be a secondary recording medium from the forward roller 123 and may not be fed by the forward roller 123. The recording medium contact part 1431 may control the recording medium P to move from a nip between the forward roller 123 and the retard roller 130 toward the paper feeding cassette 110.

The kicker 143 may include a second cam contact part 1432 contacting the second cam 156 described below. A rotation of the second cam 156 allows the second cam contact part 1432 contacting the second cam 156 to move back and forth.

As illustrated in FIGS. 1 and 2B, the retard roller 130, which is disposed on the third shaft 130*s*, is provided below the first shaft 121*s* of the pickup roller 121 and the second shaft 123*s* of the forward roller 123.

Referring again to FIGS. 3A and 3B, the second cam 156 includes a second cam trajectory 1560, which contacts the second cam contact part 1432 of the kicker 143. The second cam 156 is assembled with the driving axle 150 to rotate along with a rotation of the driving axis 150.

The rotation of the driving axis 150 causes the rotation of the second cam 156, and accordingly, the kicker 143 contacting the second cam 156 rotates about a rotation part 1434 thereof.

The second cam trajectory 1560 includes a contact section 1560*a* and a separation section 1560*b* according to a rotational phase thereof. When the contact section 1560*a* of the second cam 156 is located to face the second cam contact part 1432, the retard roller 130 is located at the contact position 130*a* according to association of the kicker 143, the lever member 141, and the holder member 133. When the separation section 1560*b* of the second cam 156 is located to face the second cam contact part 1432, the retard roller 130 is located at the release position 130*b* according to association of the kicker 143, the lever member 141, and the holder member 133.

Since the second cam 156 is assembled with the driving axle 150 with which the first cam 152 is assembled, a rotation of the driving axle 150 causes the second cam 156 to rotate together with the first cam 152. For example, when the first cam 152 moves from the pickup section 1520*a* to the release section 1520*b*, the second cam 156 may move from the contact section 1560*a* to the separation section 1560*b*. Accordingly, the knock-up plate 111 connected to the first cam 152 is raised, and simultaneously, the retard roller 130 connected to the second cam 156 is raised.

Figure 4A:
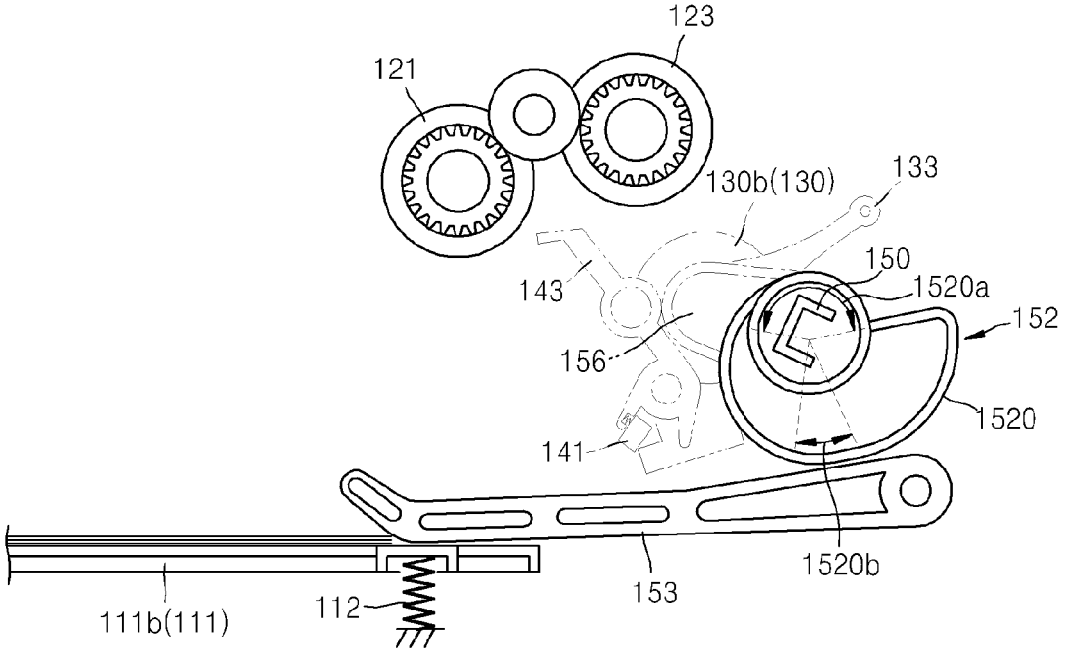
FIGS. 4A and 4B are right-side views illustrating an operating state of a knock-up plate by the first control unit and the second control unit of the paper feeding apparatus, according to an embodiment of the present general inventive concept.
Figure 4B:
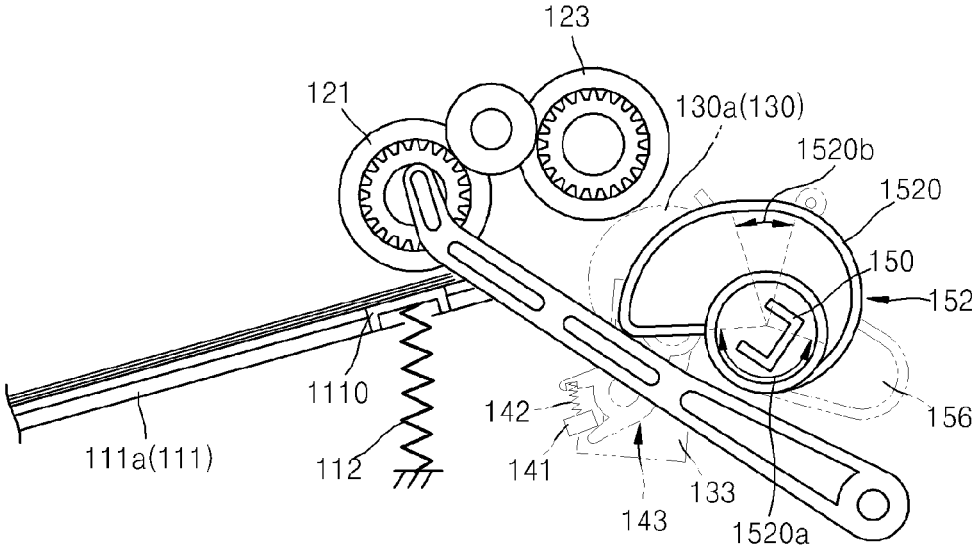
Figure 5A:
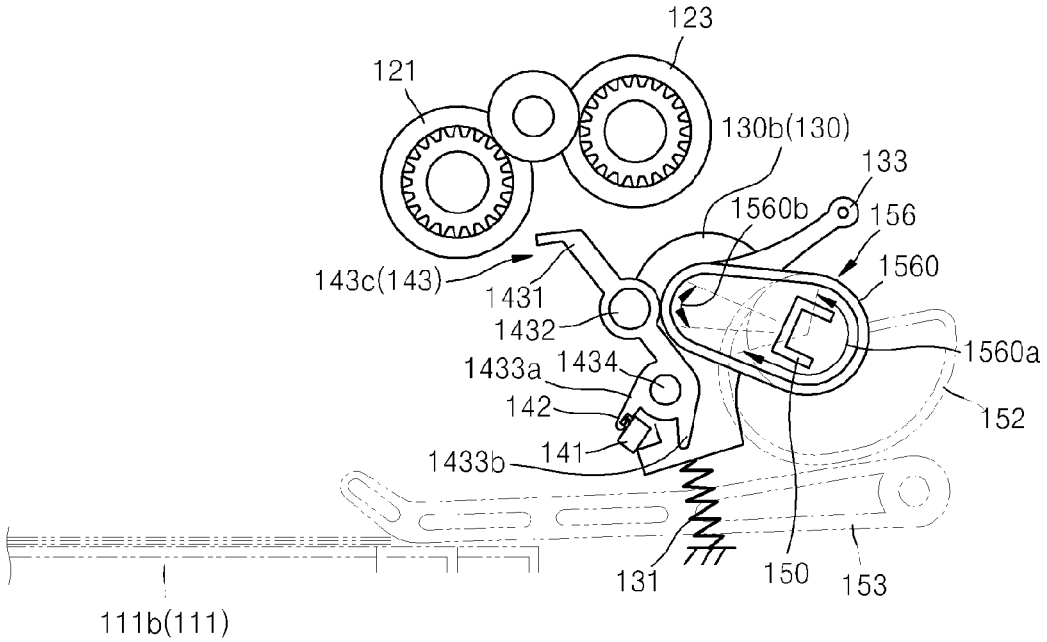
FIGS. 5A to 5C are right-side views illustrating an operating state of a retard roller and a kicker by the first control unit and the second control unit of the paper feeding apparatus, according to an embodiment of the present general inventive concept.
Figure 5B:
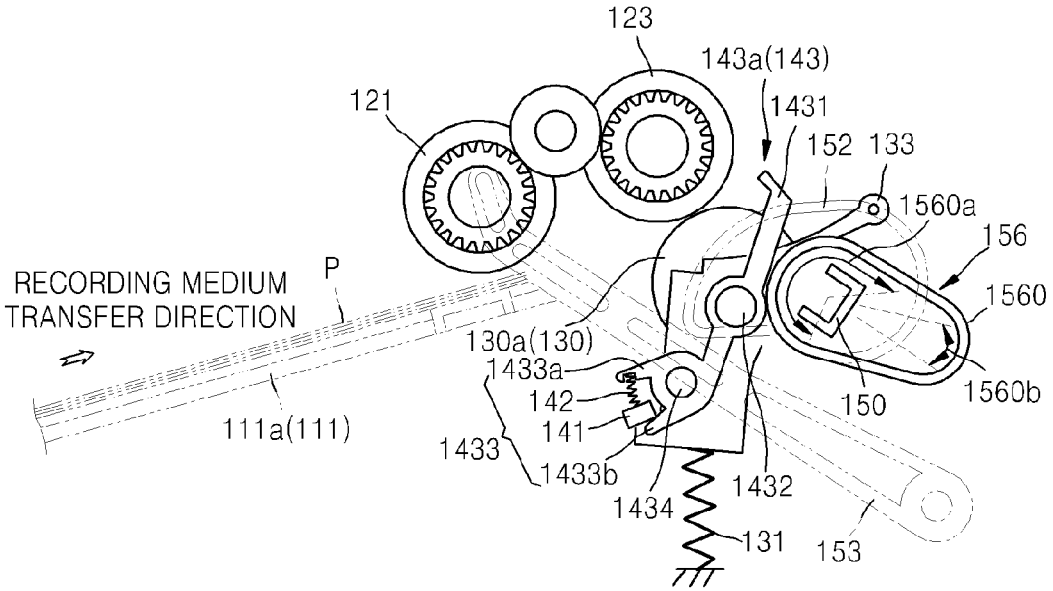
Figure 5C:
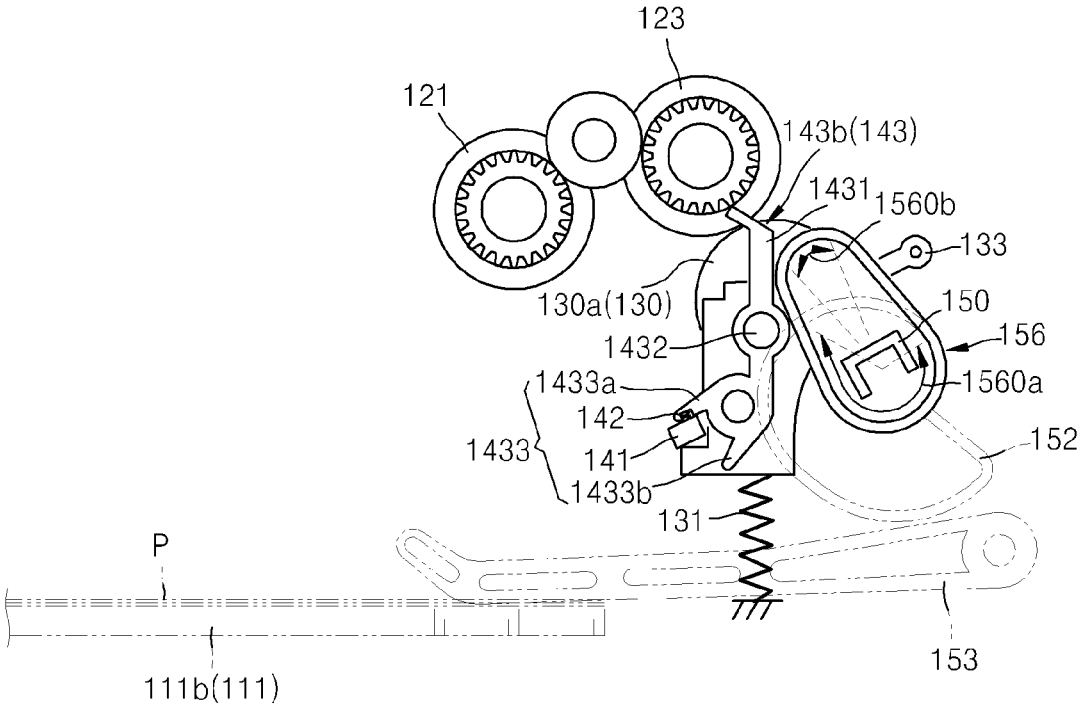

FIGS. 4A and 4B are right-side views illustrating an operating state of the knock-up plate 111 by the first control unit 151 of the paper feeding apparatus 100, according to an embodiment of the present general inventive concept, and FIGS. 5A to 5C are right-side views illustrating an operating state of the retard roller 130 and the kicker 143 by the second control unit 155 of the paper feeding apparatus 100, according to an embodiment of the present general inventive concept. In FIGS. 4A, 4B, 5A, 5B, and 5C, the frame 140 is not illustrated for the description purpose with a better view of the operating states of the first control unit 151 and the second control unit 155.

Referring to FIGS. 4A and 5A, in an initial state of the paper feeding apparatus 100 before a driving force is delivered by the driving motor M, the release section 1520*b* of the first cam 152 is located to face the knock-up lever 153, and the separation section 1560*b* of the second cam 156 is located to face the second cam contact part 1432. The first cam 152 allows the knock-up plate 111 to be located at the release position 111*b* through the knock-up lever 153, thereby the pickup roller 121 being separated from the recording media P stacked on the knock-up plate 111. The second cam 156 allows the retard roller 130 to be located at the separation position 130*b* through the kicker 143 and the lever member 141, thereby the retard roller 130 being separated from the forward roller 123. In this state, a recording medium pickup process and a multiple-paper transfer prevention process according to a rotation of the driving axis 150 will now be described.

First, an operating state of the first cam 152 and a pickup process according to the operating state will be described with reference to FIGS. 4A and 4B.

In an initial state as illustrated in FIG. 4A, the first cam 152 rotates counterclockwise. During this rotation, a distance between the driving axle 150 and the first cam trajectory 1520 is gradually shorter. As described above, since a force of the first cam 152 pressing the knock-up lever 153 downwards is gradually released, the knock-up plate 111 is raised in a direction toward the pickup roller 121 by a pressing force of the first pressure member 112 connected to a lower part of the knock-up plate 111 in a state where the recording media P are stacked on the knock-up plate 111, and the knock-up lever 153 is also raised by being pushed by the knock-up plate 111. When the recording medium P stacked on the knock-up plate 111 is disposed to make a contact with the pickup roller 121, the knock-up plate 111 stops rising. Thereafter, as illustrated in FIG. 4B, until the last point of the pickup section 1520*a* of the first cam 152 faces the knock-up lever 153, the contact between the recording media P and the pickup roller 121 is maintained by the knock-up plate 111. In this state, when a driving force of the driving motor M is delivered to the pickup roller 121 by the clutch C1, the pickup roller 121 rotates, thereby picking-up a recording medium P.

As illustrated in FIG. 4B, once the last point of the pickup section 1520*a* of the first cam 152 faces the knock-up lever 153, the first cam 152 further rotates counterclockwise. This rotation of the first cam 152 causes the last point of the pickup section 1520*a* to move away from the knock-up plate 153 and also causes the release section 1520*b* of the first cam 152 to face the knock-up lever 153. Since the knock-up lever 153 is in a contact state with the first cam 152 while a phase of the first cam 152 is switching from the pickup section 1520*a* to the release section 1520*b*, the knock-up lever 153 lowers along the first cam trajectory 1520. When the knock-up lever 153 lowers, the knock-up plate 111 contacting with a lower part of the knock-up lever 153 is lowered by a force delivered from the knock-up lever 153. The force delivered from the knock-up lever 153 is greater than an elastic force of the first pressure member 112. When the knock-up plate 111 lowers, the recording media P stacked on the knock-up plate 111 is also lowered, thereby the recording media P being separated from the pickup roller 121 again as illustrated in FIG. 4A.

That is, according to the rotation of the first cam 152 to repeat the pickup section 1520*a* and the release section 1520*b*, the knock-up plate 111 may move to the pickup position 111*a* and the release position 111*b* so that the recording media P contact with or are separated from the pickup roller 121.

Here, a time when the knock-up plate 111 is disposed at the pickup position 111*a* or a period when the knock-up plate 111 is raised or lowered may vary according to the first cam trajectory 1520 of the first cam 152 or a driving force connection of the clutch C2. For example, according to a length design of the pickup section 1520*a* of the first cam trajectory 1520, the time when the knock-up plate 111 is disposed at the pickup position 111*a* may vary. In addition, according to control of a driving force connection of the clutch C2 between the driving axle 150 and the driving motor M, the raising/lowering period of the knock-up plate 111 may vary.

Next, an operating state of the retard roller 130 and a multiple-paper transfer prevention process according to the operating state will be described with reference to FIGS. 5A to 5C.

The second cam 156 connected to the driving axle 150 rotates together with the rotation of the first cam 152 since the driving axle 150 is connected to both the first cam 152 and the second cam 156.

When the first cam 152 is in a position where the release section 1520*b* disposed to face the knock-up plate 152 as illustrated in FIG. 4A, the second cam 156 is in a position where the separation section 1560*b* is disposed to face the second cam contact part 1432. While the first cam 152 is rotating for the pickup section 1520*a* to face the knock-up lever 153 as illustrated in FIG. 4B, the second cam 156 rotates for the contact section 1560*a* to face the second cam contact part 1432 as illustrated in FIG. 5B. During this rotation, a distance between the driving axle 150 and the second cam trajectory 1560 is gradually shorter. As described above, since a force of the second cam 156 pressing the kicker 143 is gradually released, the kicker 143 and the lever member 141 cannot limit a movement of the retard roller 130 toward the forward roller 123 due to an elastic force of the second pressure member 131. Thus, the retard roller 130 is gradually raised and arrives at the contact position 130*a* to contact the forward roller 123. In this state, a driving force of the driving motor M is delivered to the pickup roller 121 by the clutch C1. A driving force of the forward roller 123 is connected to the driving force of the pickup roller 121. Thus, a recording medium P picked up by the pickup roller 121 passes through the forward roller 123 and the retard roller 130, and the forward roller 123 feeds the recording medium P to the printing device 10 by rotating in the same rotation direction as the pickup roller 121.

When a single recording medium P is picked up, since the retard roller 130 contacting a rear side of the recording medium P provides a smaller frictional force than that between a front side of the recording medium P and the forward roller 123 by a torque limiter (not illustrated), the recording medium P is fed to the printing device 10.

When more than one recording medium P are picked-up, for example, two recording media P are picked-up, the two recording media P may enter into a nip between the forward roller 123 and the retard roller 130. That is, a first recording medium P located at an upper position contacts the forward roller 123, and a second recording medium P located at a lower position contacts the retard roller 130. In this case, the retard roller 130 contacting a lower side of the second recording medium P provides a greater frictional force than that occurring between the first and second recording media P, thereby stopping feeding the second recording medium P. While the first recording medium P is fed due to a frictional force between the first recording medium P and the forward roller 123, the second recording medium P does not contact the forward roller 123 but only contacts a lower side of the first recording medium P. Since a frictional force between the lower side of the second recording medium P and the retard roller 130 is greater than a force delivered through the first recording medium P, the second recording medium P is prevented from being further fed.

While the phase of the first cam 152 changes from the pickup section 1520*a* to the release section 1520*b*, the second cam 156 rotates counterclockwise to change from the contact section 1560*a* to the separation section 1560*b*, as illustrated in FIG. 5B. Since the kicker 143 is in a contact state with the second cam 156 while the second cam 156 is rotating, the upper contact part 1433*a* of the kicker 143 presses the lever member 141 along the second cam trajectory 1560. When the lever member 141 is pressed, the holder member 133 connected to the lever member 141 is lowered by the lever member 141. The lowering of the holder member 133 causes the retard roller 130 supported by the holder member 133 to lower, resulting in the forward roller 123 and the retard roller 130 being separated from each other to return to the initial state as shown in FIG. 5A.

The rotation of the second cam 156 may cause the recording medium contact part 1431 of the kicker 143 contacting with the second cam 156 to move to a first position (143*a* of FIG. 5B), a first-to-second (or intermediate) position (143*b* of FIG. 5C), and a second position (143*c* of FIG. 5A).

The kicker 143 is located at the second position 143*c* when the second cam 156 is located at the separation section 1560*b* that corresponds to the initial state as shown in FIG. 5A. According to the rotation of the second cam 156, the kicker 143 contacting with the second cam 156 rotates about the rotation part 1434.

While the second cam 156 rotates until the contact section 1560*a* of the second cam 156 is located to face the second cam contact part 1432 as illustrated in FIG. 5B, the kicker 143 contacting the second cam 156 rotates in the recording medium transfer direction until the kicker 143 is located at the first position 143*a*. At this time, the recording medium contact part 1431 of the kicker 143 located at the first position 143*a* is not supposed to contact with the recording medium P fed between the retard roller 130 and the forward roller 123 since the third pressure member 142 is interposed between the lever member contact part 1433 and the lever member 141. The third pressure member 142 separates the lever member contact part 1433 from the lever member 141, and accordingly, the recording medium contact part 1431 rotates in the recording medium transfer direction, thereby controlling the recording medium contact part 1431 not contacting the recording medium P.

Since the lever member contact part 1433 and the lever member 141 are separated from each other by the third pressure member 142, the kicker 143 may rotate to the first-to-second position 143*b* as illustrated in FIG. 5C in a state where the retard roller 130 is maintained at the contact position 130*a*. That is, since the lever member 141 is separated from the lever member contact part 1433 while the second cam 156 is rotating from the contact section 1560*a* towards the separation section 1560*b*, even though the lever member contact part 1433 rotates, the lever member 141 is not lowered. Accordingly, since the recording medium contact part 1431 can rotate in a direction opposite to the recording medium transfer direction in a state where the retard roller 130 is located at the contact position 130*a* at which the retard roller 130 contacts a lower side of the recording medium P, the recording medium contact part 1431 stably contacts an edge of the recording medium P which remains at the nip between the forward roller 123 and the retard roller 130.

In a state where the recording medium contact part 1431 contacts with the front end of the recording medium P, a rotation of the second cam 156 causes the kicker 143 to rotate in a direction from the first-to-second position 143*b* to the second position 143*c*, i.e., a direction opposite to the recording medium transfer direction, by being pushed by the second cam 156. The rotation of the kicker 143 causes the lever member 141 contacting the kicker 143 to be lowered, thereby lowering the retard roller 130 through the holder member 133. As described above, according to the lowering of the retard roller 130 and the movement of the recording medium contact part 1431 from the first-to-second position 143*b* to the second position 143*c*, the recording medium P contacting the recording medium contact part 1431 is discharged in a direction opposite to the recording medium transfer direction.

Figure 6:
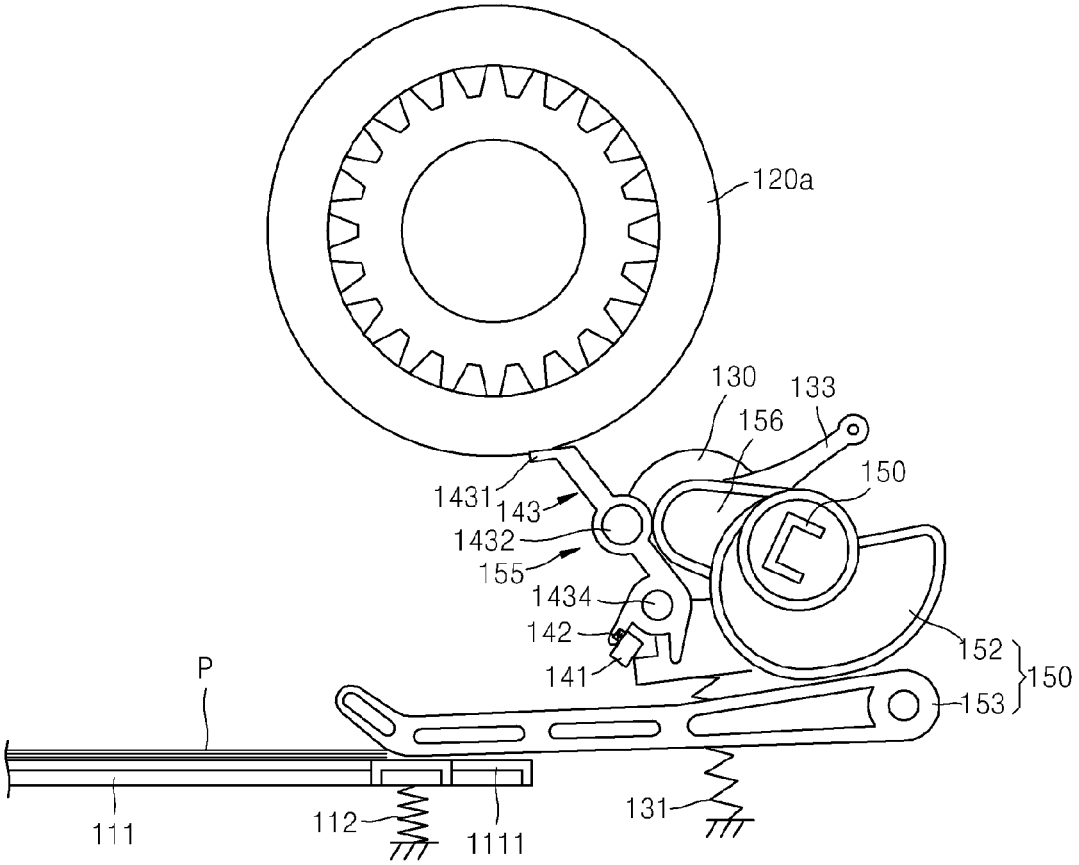
FIG. 6 is a right-side view illustrating a paper feeding apparatus according to another embodiment of the present general inventive concept.
Figure 7:
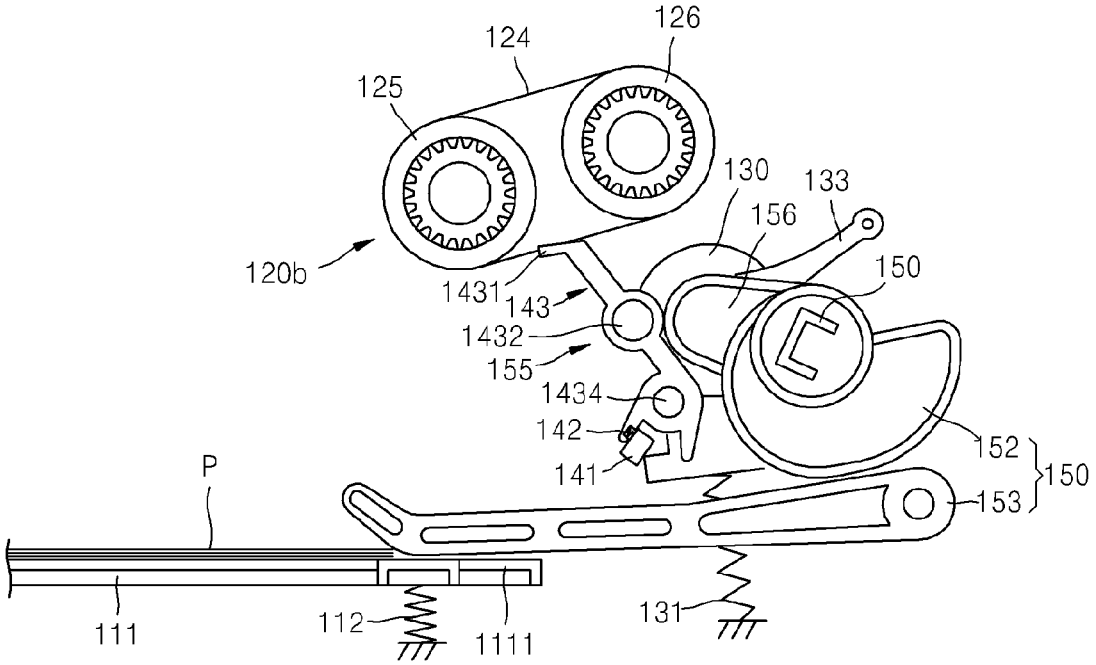
FIG. 7 is a right-side view illustrating a paper feeding apparatus according to an embodiment of the present general inventive concept.
Figure 8A:
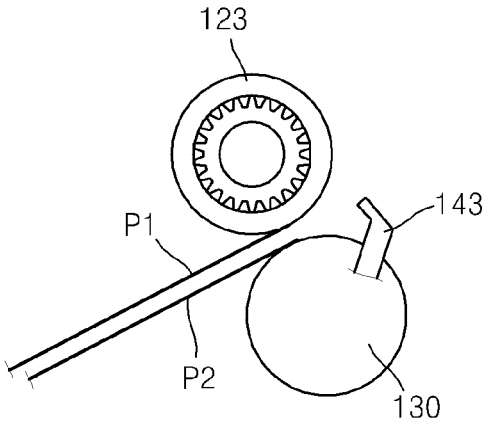
FIGS. 8A through 8F are views illustrating a multiple-paper transfer prevention process of the paper feeding apparatus of FIGS. 5A through 5C.
Figure 8B:
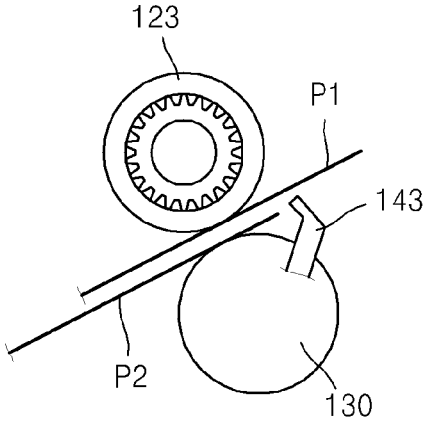
Figure 8C:
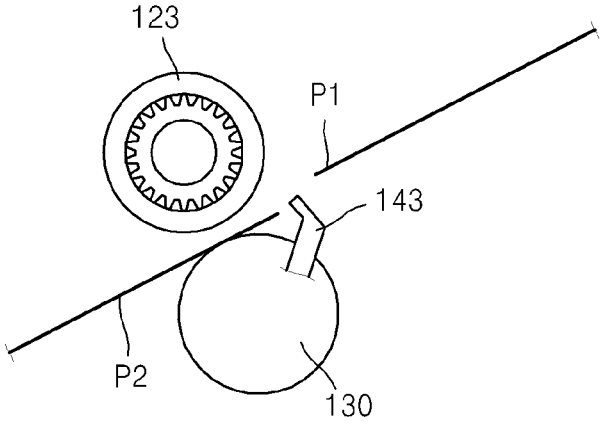
Figure 8D:
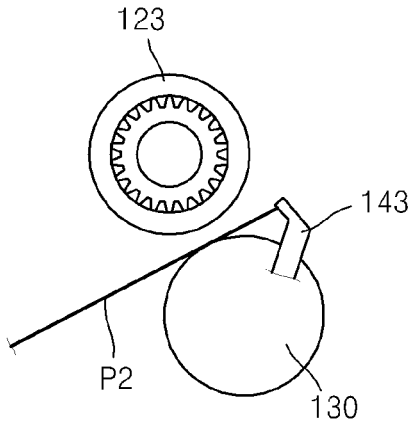
Figure 8E:
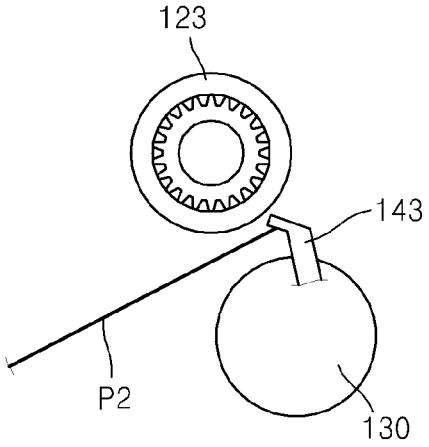
Figure 8F:
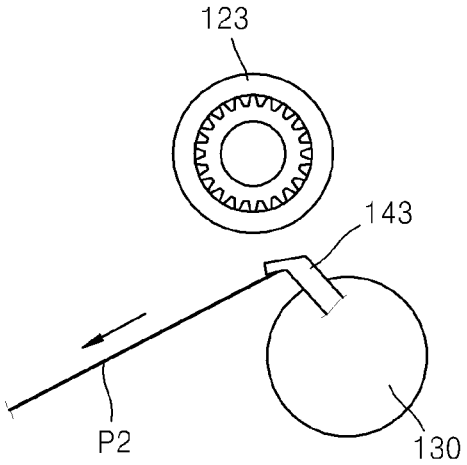

As illustrated in FIGS. 8A through 8F, a first recording medium P1 and a second recording medium P2 can enter into a space between the forward roller 123 and the retard roller 130. The first recording medium P1 is fed, but the second recording medium P2 is not fed but remains the space between the forward roller 123 and the retard roller 130. When a trailing edge of the first recording medium P1 leaves an area of the forward roller 123 and the retard roller 130 and continues to move in a recording medium transfer direction, the kicker 143 contacts a leading edge of the second recording medium P2 and pushes back the second recording medium P2 in a direction opposite to the recording medium transfer direction while the retard roller 130 is separated from the forward roller 123, according to a single driving axle 150 to perform a multiple-paper transfer prevention process of the paper feeding apparatus 100 of FIGS. 5A through 5C FIGS. 6 and 7 are right-side views illustrating a paper feeding apparatus according to an embodiment of the present general inventive concept. The paper feeding apparatus of FIGS. 6 and 7 are the same as or similar to the paper feeding apparatus 100 of FIG. 1 through FIG. 5C except the following features.

A single pickup member 120*a* may be used to simultaneously perform a recording medium pickup function of the pickup roller 121 and a recording medium separation and feeding function of the forward roller 123, as illustrated in FIG. 6. A diameter of the pickup member 120*a* may be formed larger than that of the pickup roller 121 or the forward roller 123. In this case, the knock-up plate 111 moves to a contact position with the pickup member 120*a* and a separation position from the pickup member 120*a*, and the retard roller 130 moves to a contact position with the pickup member 120 and a separation position from the pickup member 120. As illustrated in FIG. 7, a pickup member 120*b* may include supporting rollers 125 and 126 and a pickup belt 124 travelling by the supporting rollers 125 and 126. In this case, the knock-up plate 111 may be raised in a direction toward the supporting roller 125 to contact the pickup belt 124, and the retard roller 130 may be moved or raised in a direction toward the supporting roller 126 to contact the pickup belt 124.

A paper feeding apparatus and an image forming apparatus adopting the same according to an embodiment of the present general inventive concept may provide a reliable paper pick-up operation and a stable image forming operation while reducing a space limitation and costs by controlling raising and lowering of a knock-up plate and raising and lowering of a retard roller with cams connected to a single driving axle.

While the present general inventive concept has been particularly shown and described with reference to exemplary embodiments thereof, they are only illustrative. For example, although an image forming apparatus employing a printing device for forming a color image by electrophotography using cyan, magenta, yellow, and black color toners has been described in the exemplary embodiments, the present general inventive concept is not limited thereto. The image forming apparatus according to an embodiment of the present general inventive concept may be applied to image forming apparatuses to form an image on a recording medium by using various methods, such as a printing device to form a single color image by electrophotography, a printing device using ink-jet printing, and a printing device using thermal transfer printing. In addition, although a lever member and a kicker are separately formed in the embodiments of the present general inventive concept, the present general inventive concept is not limited thereto. The lever member and the kicker may be formed in a single integrated body or a single monolithic body. In addition, although a first cam and a knock-up lever are separately formed in the embodiments of the present general inventive concept, the present general inventive concept is not limited thereto. The first cam and the knock-up lever may be formed in a single integrated body or a single monolithic body.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A paper feeding apparatus comprising:

a pickup roller disposed on a first shaft;

a knock-up plate to accommodate recording media thereon and to move between a pickup position at which a recording medium contacts with the pickup roller and a release position at which the recording medium and the pickup roller are separated from each other;

a forward roller disposed on a second shaft different from the first shaft to transfer a recording medium picked up by the pickup roller;

a retard roller to move between a contact position at which the retard roller contacts with the forward roller to prevent a multiple-paper transfer by applying a frictional force to a rear side of a recording medium being transferred between the retard roller and the forward roller and a separation position at which the retard roller is separated from the forward roller, the retard roller being disposed on a third shaft below the first and the second shafts;

a first control unit to move the knock-up plate to the pickup position and the release position; and a second control unit to move the retard roller to the contact position and the separation position, wherein the first control unit and the second control unit are assembled with and in contact with different portions of a driving axle driven by a single driving motor so as to be spaced apart from each other along the driving axle, such that the retard roller is disposed above the driving axle with respect to a direction perpendicular to a recording medium transfer direction.

2. The paper feeding apparatus of claim 1, further comprising:

a first pressure member to apply a first elastic force to the knock-up plate in a direction towards the pickup position, wherein the first control unit comprises a first cam having a first cam trajectory allowing the knock-up plate to move to the pickup position by the first elastic force or to the release position by moving the knock-up plate in a direction opposite to the first elastic force according to a rotational phase of the first cam.

3. The paper feeding apparatus of claim 2, further comprising:

a second pressure member to apply a second elastic force to the retard roller in a direction towards the contact position, wherein the second control unit comprises a second cam having a second cam trajectory allowing the retard roller to move to the contact position by the second elastic force or to the separation position by moving the retard roller in a direction opposite to the second elastic force according to a rotational phase of the second cam.

4. The paper feeding apparatus of claim 3, wherein the first cam and the second cam are assembled with the driving axle rotated by the driving motor.

5. The paper feeding apparatus of claim 4, further comprising:

a kicker to move between a first position at which a recording medium is allowed to pass between the forward roller and the retard roller and a second position at which the kicker pushes a recording medium separated by the retard roller in a direction opposite to the recording medium transfer direction by the forward roller.

6. The paper feeding apparatus of claim 5, further comprising:

a frame;

a holder member to support the retard roller to be rotatable and to be supported by the frame so that the retard roller can rotatably move to the contact position and the separation position; and a lever member rotatably supported by the frame and connected to the holder member, wherein the kicker is assembled with the frame to rotatably move to the first position and the second position and connected to the lever member so that the second cam trajectory contacts with the kicker to move the retard roller through coordination of the kicker, the lever member and the holder member.

7. The paper feeding apparatus of claim 6, further comprising:

a third pressure member to apply a third elastic force to the kicker in a direction towards the first position.

8. The paper feeding apparatus of claim 7, wherein the third pressure member is interposed between the kicker and the lever member.

9. The paper feeding apparatus of claim 4, further comprising:

a knock-up lever disposed between the first cam and the knock-up plate, wherein the knock-up lever contacts the first cam trajectory to move the knock-up plate.

10. The paper feeding apparatus of claim 1, wherein a clutch is interposed between the driving motor and the first and second control units to selectively blocking a driving force.

11. An image forming apparatus comprising:

a printing device to print a recording medium;

the paper feeding apparatus of claim 1 to feed the recording medium to the printing device; and a discharge device to discharge the recording medium printed by the printing device.

12. The paper feeding apparatus of claim 1, wherein the driving axle is rotated in a single direction of rotation by the single driving motor.

13. A paper feeding apparatus comprising a pickup member having a pickup roller disposed on a first shaft and a forward roller disposed on a second shaft different from the first shaft to pick up and transfer a recording medium, a knock-up plate to accommodate recording media and to contact a recording medium with the pickup member, and a retard roller to apply a frictional force to a rear side of a recording medium being transferred between the retard roller and the pickup member, the paper feeding apparatus comprising:

a first cam to control the knock-up plate to be raised or lowered with respect to the pickup member;

a second cam to control the retard roller to contact or be rotatably separated from the pickup member such that the retard roller is disposed on a third shaft below the first and the second shafts;

a driving axle assembled with and contacting the first cam and the second cam at different portions of the driving axle, the first cam and the second cam being spaced apart from each other along the driving axle, such that the retard roller is disposed above the driving axle with respect to a direction perpendicular to a recording medium transfer direction; and a driving motor to rotate the driving axle.

14. The paper feeding apparatus of claim 13, further comprising:

a first pressure member to apply a first elastic force to the knock-up plate in a direction towards the pickup member; and a second pressure member to apply a second elastic force to the retard roller in the direction towards the pickup member.

15. The paper feeding apparatus of claim 14, further comprising:

a kicker to move between a first position at which a recording medium is allowed to pass between the pickup member and the retard roller and to a second position at which the kicker pushes a recording medium separated by the retard roller in a direction opposite to the recording medium transfer direction by the pickup member, wherein the second cam moves the kicker to the first position and the second position.

16. The paper feeding apparatus of claim 15, further comprising:

a third pressure member to apply a third elastic force to the kicker in a direction towards the first position.

17. The paper feeding apparatus of claim 15, wherein the second cam, through operating the kicker, controls the retard roller to contact or be separated from the pickup member.

18. An image forming apparatus comprising:

a printing device to print a recording medium;

the paper feeding apparatus of claim 13 to feed the recording medium to the printing device; and a discharge device to discharge the recording medium printed by the printing device.

19. A paper feeding apparatus usable with an image forming apparatus, the paper feeding apparatus comprising:

a knock-up plate to accommodate recording media thereon;

a pickup roller disposed on a first shaft to pick up a recording medium from the knock-up plate;

a forward roller disposed on a second shaft different from the first shaft to receive the picked up the recording medium;

a retard roller disposed on a third shaft below the first and the second shafts to transfer the picked up recording medium with the forward roller in a transferring direction;

a first control unit to control the knock-up plate to move with respect to the pickup roller;

a second control unit to control the retard roller to move with respect to the forward roller; and a single driving axle connected to and contacting the first control unit and the second control unit at different portions of the driving axle, the first control unit and the second control unit being spaced apart from each other along the driving axle, such that the retard roller is disposed above the driving axle with respect to a direction perpendicular to the transferring direction.

20. The paper feeding apparatus of claim 19, further comprising:

a kicker connectable to the single driving axle to remove a second recording medium from a space between the forward roller and the retard roller, wherein the recording medium and the second recording medium are picked up and fed between the forward roller and the retard roller, the recording medium is transferred according to a friction of the forward roller, and the second recording medium remains in the space according to a friction of the retard roller.

21. The paper feeding apparatus of claim 19, wherein:

the first control unit comprises a first cam to move the knock-up plate to a pickup position and a release position; and the second control unit comprises a second cam to move the retard roller to a contact position and a separation position.

22. The paper feeding apparatus of claim 19, further comprising:

a single driving motor to generate a first driving force to the pickup roller and a second driving force to the signal driving axle.

* * * * *